US007189138B1

(12) United States Patent
Utaka

(10) Patent No.: US 7,189,138 B1
(45) Date of Patent: Mar. 13, 2007

(54) BRASSIERE WIRE

(75) Inventor: Shohei Utaka, Kasai (JP)

(73) Assignees: UTAX Co., Ltd., Nishiwaki (JP); UTAV U.S.A., Inc., New York, NY (US)

( * ) Notice: Subject to any disclaimer, the term of this patent is extended or adjusted under 35 U.S.C. 154(b) by 0 days.

(21) Appl. No.: 11/244,701

(22) Filed: Oct. 6, 2005

(51) Int. Cl.
*A41C 3/14* (2006.01)
*A41C 3/12* (2006.01)

(52) U.S. Cl. ..... 450/41; 450/51; 450/52

(58) Field of Classification Search ..... 450/41, 450/45, 47, 48, 50–53; 2/255–258, 260, 2/260.1, 261, 264
See application file for complete search history.

(56) References Cited

U.S. PATENT DOCUMENTS 3,599,643 A * 8/1971 Schwartz ..... 450/41
3,605,753 A * 9/1971 Schwartz ..... 450/52
3,880,948 A * 4/1975 Chompff ..... 525/119
4,133,316 A * 1/1979 Schwartz ..... 450/52
4,271,580 A * 6/1981 King et al. ..... 29/447
4,777,668 A * 10/1988 Weston ..... 2/257
5,730,641 A * 3/1998 Brown ..... 450/41
5,749,767 A * 5/1998 Arceo ..... 450/41
5,830,040 A * 11/1998 Morgan et al. ..... 450/41
5,934,970 A * 8/1999 Morgan et al. ..... 450/41
5,951,365 A * 9/1999 Fildan ..... 450/41
6,066,027 A * 5/2000 Fildan ..... 450/52
6,733,854 B2 * 5/2004 Lee et al. ..... 428/35.8

* cited by examiner

*Primary Examiner*—Gloria M. Hale
(74) *Attorney, Agent, or Firm*—Day Pitney LLP

(57) ABSTRACT

There is disclosed a brassiere wire with a plastic protective cap at an end portion of the wire. A liquid primer is coated between the wire and the protective cap, wherein the protective cap is fixed on the wire by high frequency bonding through the liquid primer. Preferably, the wire and protective cap are cooled after high frequency bonding. The brassiere wire is free of a notch or a hole.

5 Claims, 5 Drawing Sheets

BRASSIERE WIRE

BACKGROUND OF THE INVENTION

The main stream brassiere wire of today has a resin protective cap 2 attached to the tip of wire 1 as illustrated in FIG. 1 to prevent the metal wire from projecting through a fabric casing or to improve the wearer's comfort. There are several methods of attaching protective cap 2 ranging from a simple insertion of protective cap 2 to insert-molding of the wire with protective cap 2.

The major problem of the wire having a protective cap is that the protective cap detaches from the wire during wearing or washing. In order to overcome this problem, wire suppliers provide means to make the protective cap hard to detach from the wire by forming a hole or notch at the tip of the wire as disclosed in U.S. Pat. No. 4,133,316. As a result, the protective cap with a hole or notch is less likely to detach from the wire than the one without a hole or notch; this does not mean that the protective cap with a hole or notch never detaches from the wire.

On the contrary, the presence of a hole or notch formed at the wire tip increases a hazard when the protective cap detaches. For this reason, it is desirable to enhance the holding strength of the protective cap without forming a hole or notch at the wire tip portion.

More particularly, as illustrated in FIGS. 2*a* and 2*b*, the conventional method involves the formation of notches or the like at the tip of wire 1*a* and the formation of a hole on protective cap 2*a* at the point which corresponds to the notch so as to mate and secure the protective cap 2*a* on wire 1*a*.

However, protective cap 2*a* is hard to attach unless the size of the hole on the protective cap and that of the wire hook portion have some tolerance. As a result, the wire hook portion has too much play. This weakens the holding strength, causing a detachment of the protective cap during wearing or washing. In addition, the area on the protective cap in which a hole is formed provides much poorer strength than other areas. As a result, the protective cap often disintegrates from the hole thereof during washing.

Hence, in the past, instead of separately molding a protective cap and attaching it to the wire, the insert-molding method was devised as disclosed in U.S. Pat. Nos. 4,306,565 and 5,934,970. This insert-molding of a protective cap enhanced the adherence between the wire and the protective cap, thereby reducing the chance of disintegration during washing.

Nevertheless, the protective cap had a poor holding capacity unless a notch or hole was formed on wire body 1*b* and a hook was made as illustrated in FIGS. 3*a* and 3*b*. Furthermore, this wire insert-molding had a characteristic that both ends were covered with a resin. As a result, a continuous molding used for electronic components and the like could not be adopted for production of protective caps, entailing poor productivity.

SUMMARY OF THE INVENTION

The means the inventors developed could successfully enhance the holding strength of the protective cap without processing the wire tip portion. The protective cap is as strong as or stronger than that of the protective cap having a notch or the like formed at the wire tip portion.

The present invention provides a means for improving holding capacity and washing resistance without forming a notch at the tip of a wire or providing insert-molding. In addition, the use of a protective cap in stock provides better productivity than insert-molding.

BRIEF DESCRIPTION OF THE DRAWINGS

The above objects, and other features and advantages of the present invention will become more apparent after reading the following detailed description when taken in conjunction with the drawings, in which:

FIGS. 2*a* and 2*b* are plan views of a conventional wire having a notch at the tip portion thereof to prevent the protective cap from detaching from the wire, wherein FIG. 2*a* illustrates the brassiere after the protective cap is attached and FIG. 2*b* illustrates a wire and a protective cap before the protective cap is attached to the wire;

FIGS. 3*a* and 3*b* are plan views of another conventional brassiere wire, in which a notch is provided at the tip portion of the wire and a protective cap is attached thereto by insert-molding, wherein FIG. 3*a* is a cross-section cut through the wire plane after the protective cap is attached thereto and FIG. 3*b* is a diagram illustrating a single body of the wire.

FIGS. 4*a*, 4*b* and 4*c* illustrate an embodiment of the present invention, wherein FIG. 4*a* is a diagram of a single body of the protective cap; FIG. 4*b* is a diagram illustrating a wire in which a liquid primer is coated onto the tip portion of the wire and FIG. 4*c* is a cross section cut through the wire plane after the protective cap is attached thereto.

DETAILED DESCRIPTION OF THE INVENTION

Figure 1:
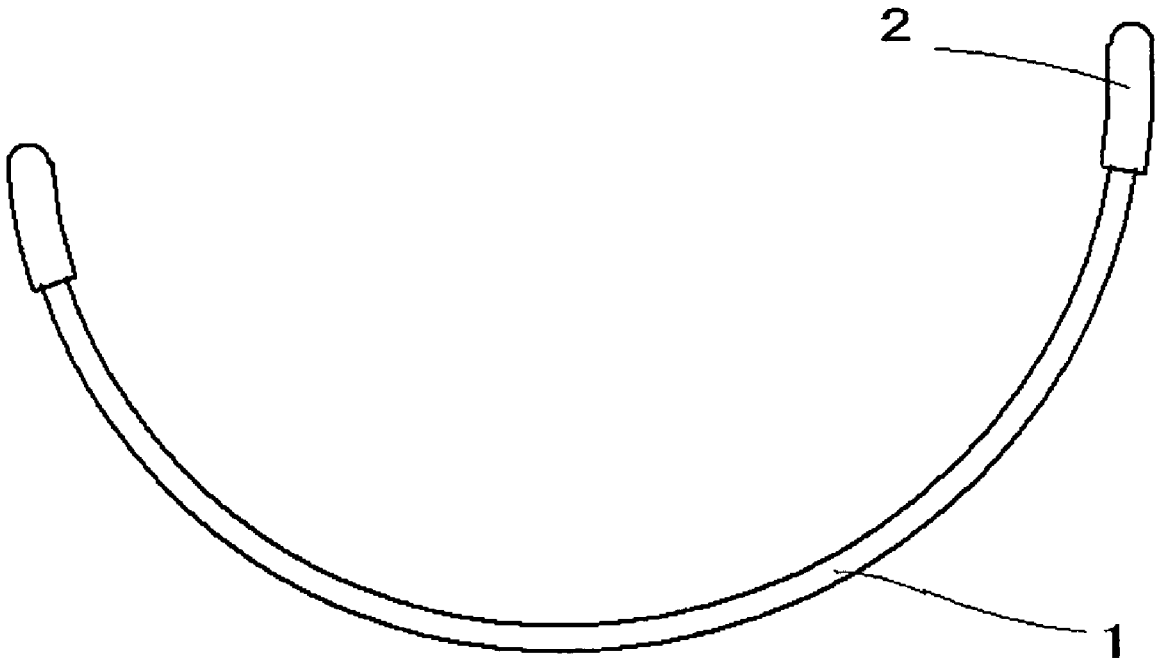
FIG. 1 PRIOR ART
FIG. 1 is a diagram illustrating a conventional brassiere wire.
Figure 2A:
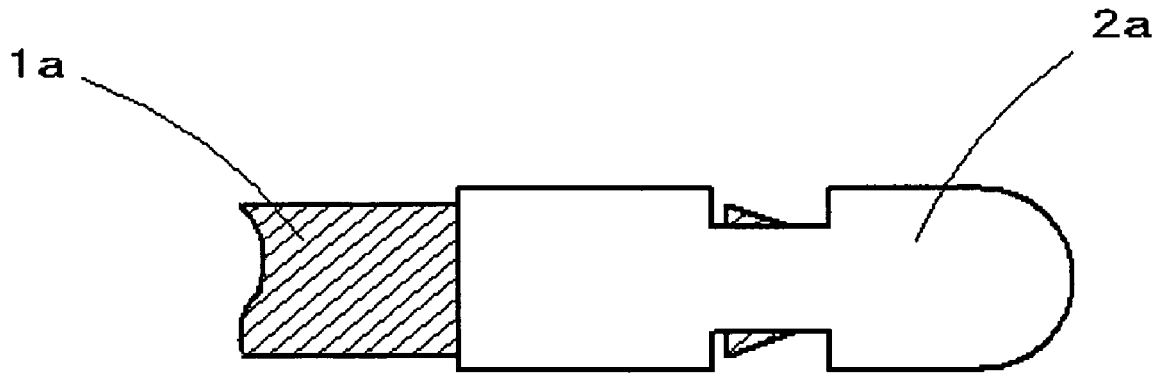
Figure 2B:
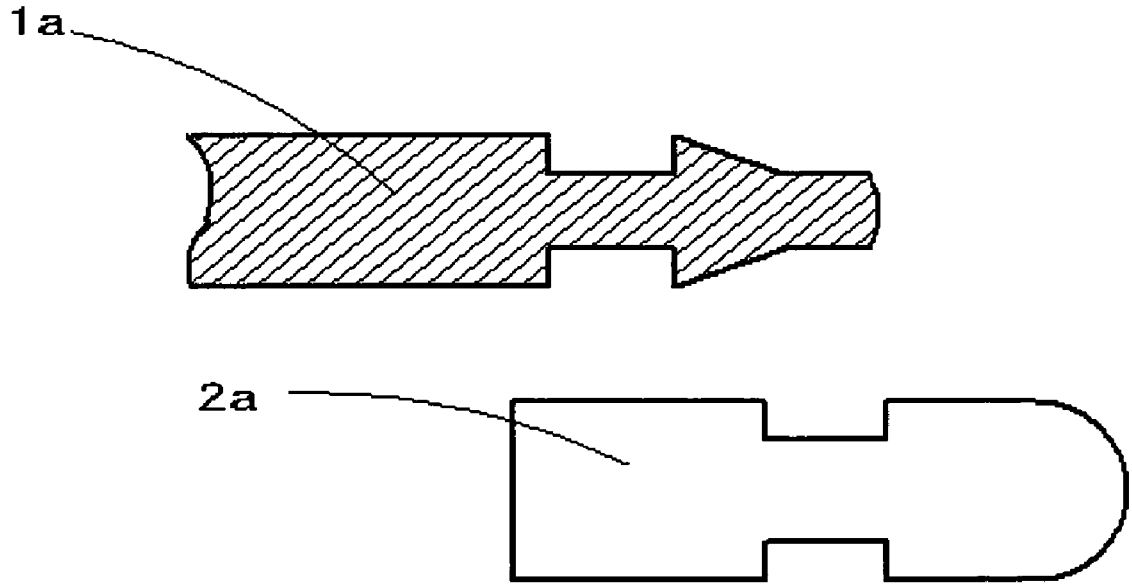
FIG. 2b PRIOR ART
Figure 3A:
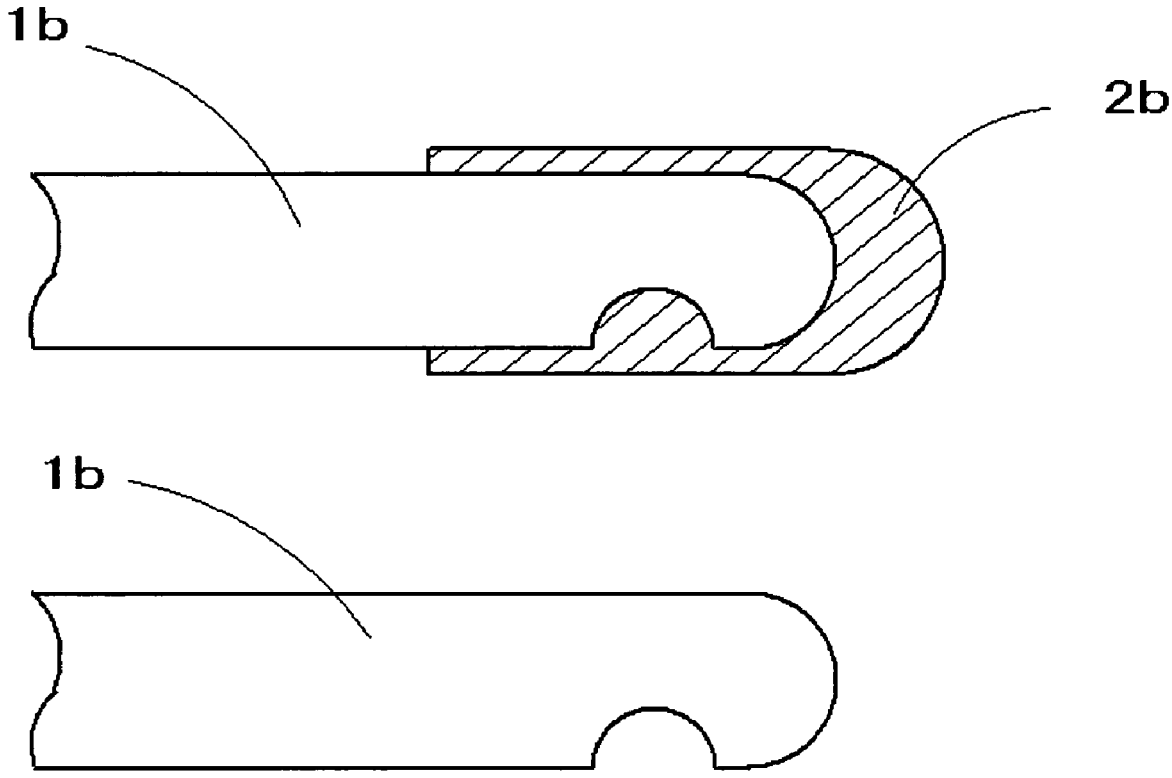
FIG. 3a PRIOR ART
Figure 3B:
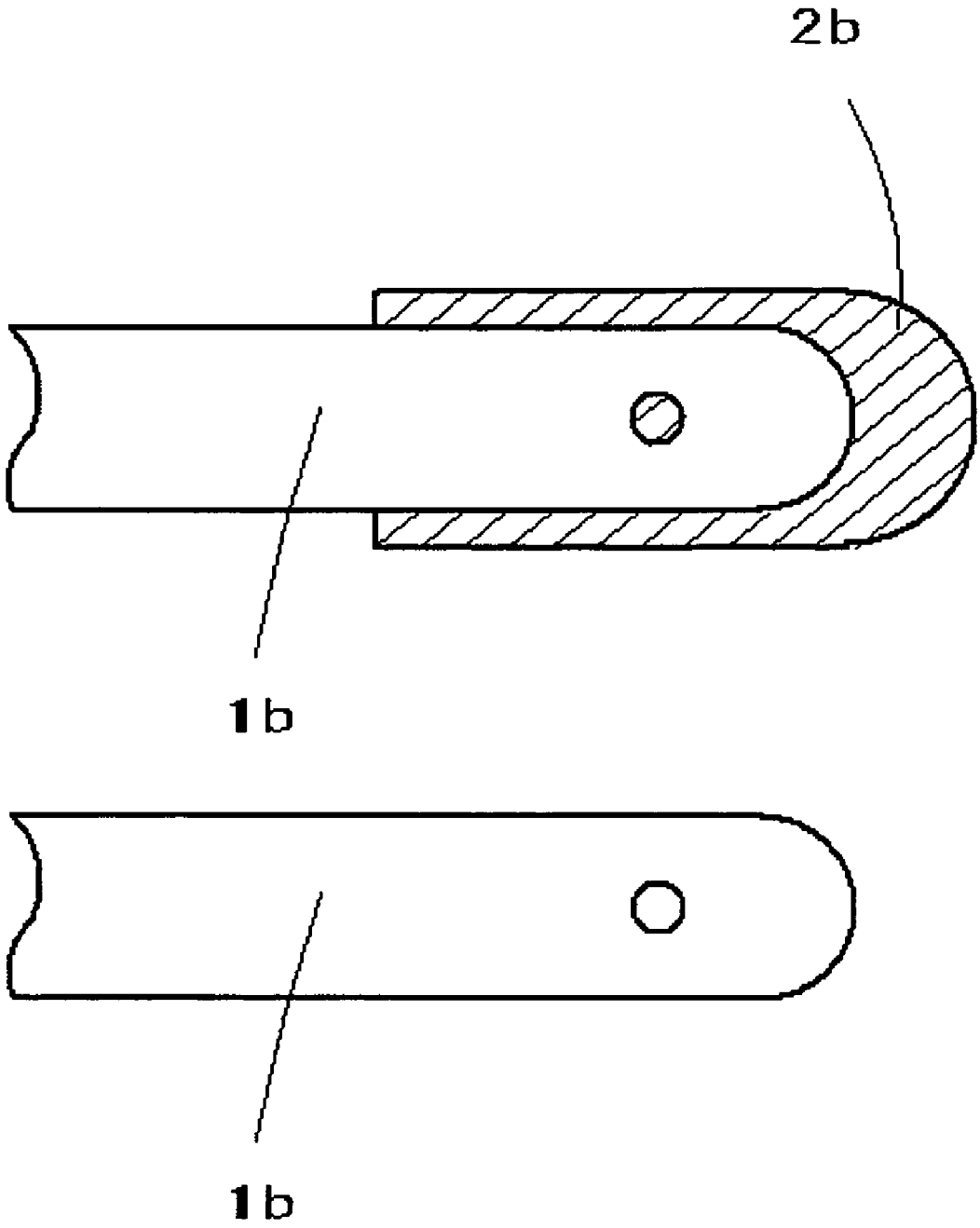
FIG. 3b PRIOR ART
Figure 4A:
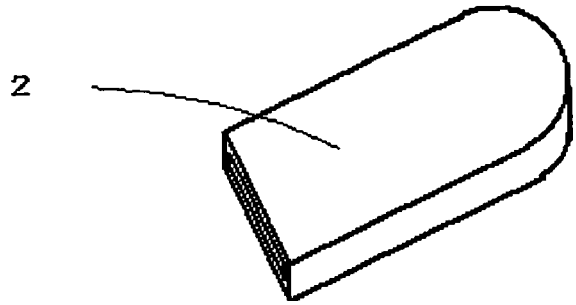
Figure 4B:
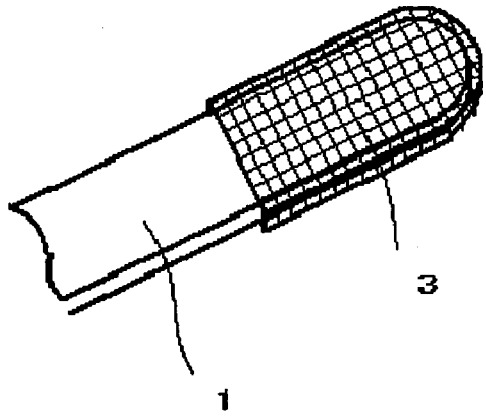
Figure 4C:
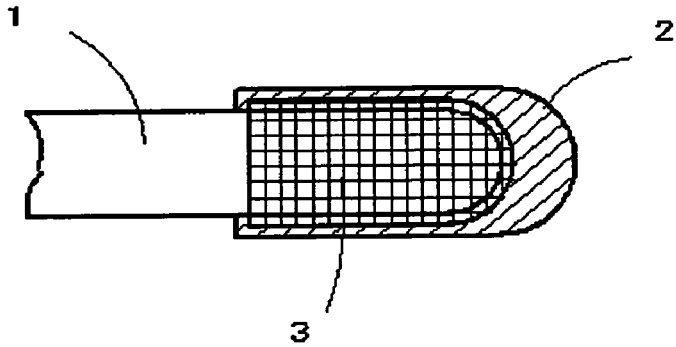

As illustrated in FIGS. 4*a*, 4*b* and 4*c*, a liquid primer 3 is coated in the region in which a protective cap of a wire is attached. Protective cap 2 is attached and is held while being pressed after high frequency bonding is provided. The holding capacities of protective cap 2 were as follows wherein a holding capacity is represented by the maximum value measured when a protective cap starts sliding along the wire:

13.5 kgf when a notch or the like was formed at the tip portion of the wire and protective cap 2 was insert molded;

10.1 kgf when protective cap 2 was attached to the notch free wire and was high frequency bonded;

15.6 kgf when a liquid primer was coated on the tip portion of the notch free wire and protective cap 2 was attached thereto, and high frequency bonding was provided thereto; and 18.7 kgf when a liquid primer was coated onto the tip portion of the notch free wire and protective cap 2 was attached, high frequency bonded, and held thereon while being pressed.

It can be seen that a reasonable strength can be obtained without using a liquid primer. However, after washing which is described next, a significant difference in holding capacity of the protective cap was observed (washing was repeated 25 times using a commercial fully automated washing machine used by AATCC (American Association of Textile Chemists and Colorists).

The post-washing holding capacity I was 0.5 kgf when the protective cap was simply high frequency bonded onto the tip portion of the notch free wire without coating with a liquid primer; this holding capacity measured after washing was much poorer than that measured before washing.

The post washing capacity was 2.4 kgf even when a liquid primer was coated and the protective cap was high frequency bonded. This holding capacity is somewhat better than that measured without liquid primer coating, but not up to the pre-washing level. With the liquid primer coating on the wire, high frequency bonding of a protective cap and holding of the protective cap onto the wire while pressing, a good post washing holding capacity of 13.8 kgf was obtained.

As compared to the present invention, the post-washing holding capacity of the protective cap was 12.3 kgf when a notch was formed at the tip portion of a wire and a protective cap was attached by insert-molding. Table 1 illustrates the holding capacities of a protective cap measured under different conditions. It is apparent from the results that the present invention is superior.

It is worth noting that a liquid primer must be selected in accordance with the material of which the protective cap is made. For a nylon elastomer type protective cap used for the present invention, acrylic denatured epoxy type resin mixture is preferable. A typical example of the liquid primer used with the present invention is chemical product W-200 commercially available from Arkema K.K. Tokyo, Japan.

TABLE 1

Holding Strengths of Caps Shipped as Samples

| | Prior Art | Comparative Sample 1 | Comparative Sample 2 | Present Invention |
|---|---|---|---|---|
| Before Washing | 13.5 | 10.1 | 15.6 | 18.7 |
| After Washing | 12.3 | 0.5 | 2.4 | 13.8 |

TABLE 2

Manufacturing Methods

| | |
|---|---|
| Prior Art | A notch & insert-molding. |
| Comparative Sample 1 | A cap attachment and ultrasound process only. |
| Comparative Sample 2 | Primer coating and natural dry.<br>A cap attached and ultrasound processed. |
| Present Invention | Primer coating & high frequency bonding process & pressing. |

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A brassiere wire comprising:

a wire having an end portion, wherein the end portion is free of a notch or a hole;

a protective cap fixed at the end portion of the wire; and a cured primer disposed between the wire and the protective cap, wherein the protective cap is fixed on the end portion of the wire by high frequency bonding of a liquid primer between the wire and the protective cap, and wherein the protective cap exhibits a post-washing holding capacity greater than 12.3 kilograms.

2. The brassiere wire as set forth in claim 1 wherein the protective cap comprises nylon elastomer and the liquid primer comprises a mixture of an acrylic denatured epoxy type resin.

3. A method for manufacturing a brassiere wire comprising the steps of:

providing a wire having end portions, wherein the end portions are free of a notch or a hole;

providing a protective cap for fixing to the end portions of the wire;

applying a liquid primer to the end portions of the wire;

positioning the protective cap on the end portions of the wire;

bonding the protective cap onto the end portions of the wire with high frequency bonding; and applying pressure and cooling the end portions of the wire and the protective cap to secure the bonding between the wire and protective cap, wherein the cooled end portion exhibit a post-washing holding capacity greater than 12.3 kilograms.

4. The brassiere wire as set forth in claim 1 wherein the post washing holding capacity is 13.8 kilograms.

5. The method as set forth in claim 3 wherein the post washing holding capacity is 13.8 kilograms.

* * * * *

UNITED STATES PATENT AND TRADEMARK OFFICE

CERTIFICATE OF CORRECTION

PATENT NO. : 7,189,138 B1
APPLICATION NO. : 11/244701
DATED : March 13, 2007
INVENTOR(S) : Shohei Utaka It is certified that error appears in the above-identified patent and that said Letters Patent is hereby corrected as shown below:

Title Page, Item (73) Assignee, should read:

(73) Assignees: UTAX Co., Ltd., Nishiwaki (JP);
UTAX U.S.A., Inc., New York, NY (US)

Signed and Sealed this

Third Day of August, 2010

David J. Kappos

David J. Kappos
*Director of the United States Patent and Trademark Office*